US006406547B1

(12) United States Patent
Donovan et al.

(10) Patent No.: US 6,406,547 B1
(45) Date of Patent: Jun. 18, 2002

(54) SUGAR BEET MEMBRANE FILTRATION PROCESS

(75) Inventors: Michael Donovan, Great Dunmow (GB); Robert P. Jansen, Chevy Chase, MD (US); Marc Hlavacek, London (GB); Gordon Walker, Whitchurch Hill (GB); John C. Williams, Wokingham (GB)

(73) Assignees: Tate & Lyle Industries, Limited, London (GB); Tate & Lyle, Inc., Decatur, IL (US)

( * ) Notice: Subject to any disclaimer, the term of this patent is extended or adjusted under 35 U.S.C. 154(b) by 48 days.

(21) Appl. No.: 09/618,416

(22) Filed: Jul. 18, 2000

(51) Int. Cl.[7] ..... C13D 3/16; C13D 1/02

(52) U.S. Cl. ..... 127/55; 127/43; 127/46.2; 127/48; 127/52; 127/54

(58) Field of Search ..... 127/43, 46.2, 48, 127/52, 53, 54, 55

(56) References Cited

U.S. PATENT DOCUMENTS

| | | | | |
|---|---|---|---|---|
| 1,578,463 | A | 3/1926 | Nicholson et al. | |
| 1,815,276 | A | 7/1931 | Schwieger | |
| 2,164,186 | A | 6/1939 | Brown et al. | 127/50 |
| 2,557,800 | A | 6/1951 | Seailles | 127/52 |

(List continued on next page.)

FOREIGN PATENT DOCUMENTS

| | | |
|---|---|---|
| CS | 107886 | 7/1963 |
| DE | 813139 | 9/1951 |
| DE | 942552 | 5/1956 |
| DE | 1 003 150 | 8/1957 |
| EP | 0 126 512 | 11/1984 |
| EP | 0957178 A2 | 11/1999 |
| GB | 477312 | 3/1936 |
| GB | 1 361 674 | 7/1974 |
| WO | WO92/08810 | 5/1992 |
| WO | WO92/10948 | 7/1992 |
| WO | WO93/07766 | 4/1993 |
| WO | WO98/24331 | 6/1998 |

OTHER PUBLICATIONS

PCT/US00/22301, International Search Report (May 29, 2001).

Nielsen et al., "Prospects and Possibilities in Application of Membrane Filtration Systems Within the Beet and Cane Sugar Industry," *Sugar Technology Reviews* 9:59–117 (1982), no month provided.

Kishihara et al., "Improvement of Flux in Ultrafiltration of Cane Juice," *Int. Sugar Jnl.* 85:99–102 (1983), no month provided.

(List continued on next page.)

*Primary Examiner*—David Brunsman
(74) *Attorney, Agent, or Firm*—Williams, Morgan & Amerson, P.C.

(57) ABSTRACT

A process for producing sugar from beets includes the step of filtering a sucrose-containing feed juice, which has been obtained by diffusion from sliced sugar beets, through a first ultrafiltration membrane that has a first molecular weight cutoff. This ultrafiltration step produces a first ultrafiltration permeate and a first ultrafiltration retentate. The first ultrafiltration permeate is filtered through a second ultrafiltration membrane that has a second molecular weight cutoff that is lower than the first molecular weight cutoff. This second ultrafiltration step produces a second ultrafiltration permeate and a second ultrafiltration retentate. The second ultrafiltration permeate is nanofiltered through a nanofiltration membrane, thereby producing a nanofiltration permeate and a nanofiltration retentate. The nanofiltration retentate has a higher concentration of sucrose on a dry solids basis than the feed juice in step (a), and can be used in evaporation and crystallization operations to produce crystals of white sugar. The process can optionally include ion exchange and/or electrodialysis purification steps, prior to or after the nanofiltration step. Recycle syrups can be treated with enzyme or a chromatographic separator to remove raffinose.

43 Claims, 2 Drawing Sheets

U.S. PATENT DOCUMENTS

| | | | | |
|---|---|---|---|---|
| 2,697,049 | A | 12/1954 | Brieghel-Müller | 127/50 |
| 2,801,940 | A | 8/1957 | Stark et al. | 127/44 |
| 2,824,028 | A | 2/1958 | Zenzes | 127/50 |
| 2,977,253 | A | 3/1961 | Grandadam | 127/50 |
| 3,113,044 | A | 12/1963 | Alston | 127/48 |
| 3,168,419 | A | 2/1965 | Gale | 127/50 |
| 3,926,662 | A | 12/1975 | Rundell et al. | 127/48 |
| 4,057,437 | A | 11/1977 | Kracklauer | 127/9 |
| 4,115,147 | A | 9/1978 | Shimizu et al. | 127/54 |
| 4,328,043 | A | 5/1982 | Freytag et al. | 127/44 |
| 4,332,622 | A | 6/1982 | Hohnerlein, Jr. | 127/41 |
| 4,432,806 | A | 2/1984 | Madsen et al. | 127/48 |
| 4,478,645 | A | 10/1984 | Gudnason | 127/57 |
| 4,702,839 | A | 10/1987 | Koerts et al. | 210/638 |
| 4,716,044 | A | 12/1987 | Thomas et al. | 426/51 |
| 4,795,494 | A | 1/1989 | Toth et al. | 127/48 |
| 5,145,584 | A | 9/1992 | Swamikannu | 210/650 |
| 5,254,174 | A | 10/1993 | Hansen et al. | 127/53 |
| 5,281,279 | A | 1/1994 | Gil et al. | 127/46.1 |
| 5,320,681 | A | 6/1994 | Moe et al. | 127/46.1 |
| 5,403,604 | A | 4/1995 | Black, Jr. et al. | 426/330.5 |
| 5,454,952 | A | 10/1995 | Brewer | 210/651 |
| 5,466,294 | A | 11/1995 | Kearney et al. | 127/42 |
| 5,468,300 | A | 11/1995 | Monclin | 127/43 |
| 5,468,301 | A | 11/1995 | Monclin | 127/43 |
| 5,480,490 | A | 1/1996 | Toth et al. | 127/42 |
| 5,554,227 | A | 9/1996 | Kwok et al. | 127/58 |
| 5,685,990 | A | 11/1997 | Saugmann et al. | 210/650 |
| 5,747,089 | A | 5/1998 | Ljusberg et al. | 426/478 |
| 5,759,283 | A | 6/1998 | Ekern et al. | 127/42 |
| 5,902,408 | A | 5/1999 | Player et al. | 27/30 |
| 5,902,409 | A | 5/1999 | Kwok et al. | 127/58 |

OTHER PUBLICATIONS

Hanssens et al., "Ultrafiltration as an Alternative for Raw Juice Purification in the Beet Sugar Industry" (17$^{th}$ General Assembly of C.I.T.S., Copenhagen 1983), no month provided.

"Membrane Filtration," *Food Engineering* (Nov. 1987).

"Purification Using Membrane Filtration," *Sugar Journal* (Nov. 1994).

Abram et al., "Sugar Refining: Present Technology and Future Developments," *Sugar: Science and Technology*, Chapter 3, pp. 49–95 (1979), no month provided.

Kort, "Colour in the Sugar Industry," *Sugar: Science and Technology*, Chapter 4, pp. 97–130 (1979), no month provided.

Reinefeld, "Progress in the Technology of Beet–Sugar," *Science and Technology*, Chapter 5, pp. 131–149 (1979), no month provided.

Chen, "Outline of Process for Manufacturing Raw Cane Sugar," *Cane Sugar Handbook*, Chapter 2, pp. 47–105, 127–186 and 526–559 (1985), no month provided.

Lancrenon et al., "Mineral Membranes for the Sugar Industry," *Sugar y Azucar*, pp. 40–45 (1993), no month provided.

Hartmann, "Lime and Carbon Dioxide Production," *Beet–Sugar Technology*, Chapter XVII, pp. 567–593 (1982), no month provided.

Toth, "The Wescot Juice Purification System" (1989 ASSBT Meeting, New Orleans, Louisiana, Feb. 26–Mar. 2, 1989).

"Beet Sugar Process," Western Sugar, no date provided.

Derwent Abstract, DD 136455 (1979), no month provided.

Derwent Abstract, DE 3229345 (1984), no month provided.

Derwent Abstract, EP 635578 (1995), no month provided.

Derwent Abstract, EP 655507 (1995), no month provided.

Derwent Abstract, RU 2016637 (1994), no month provided.

Derwent Abstract, JP 5004929 (1993), no month provided.

Derwent Abstract, JP 6287199 (1994), no month provided.

Derwent Abstract, SU 1669984 (1991), no month provided.

Derwent Abstract, NL 8800175 (1989), no month provided.

Derwent Abstract, FR 2586360 (1987), no month provided.

Derwent Abstract, US 4999116 (1991), no month provided.

Derwent Abstract, US 5008254 (1991), no month provided.

Derwent Abstract, SU 1756817 (1992), no month provided.

Derwent Abstract, WO 9208810 (1992), no month provided.

Freeman, "New Processes for Recovering Sugar from Sugar Beets," *Sugar* 48:161–162 (1953), no month provided.

Dorfeldt, "Manufacture of Sugar from Rasped Beets," *Zeitschrift Zuckerindustrie* 2:379–383 (1952), no month provided.

Brownell et al., "Explosion Process for Recovering Sugar from Sugar Beets," *Sugar*, p. 66 (1952), no month provided.

Cheryan, "Membrane Separation Processes and Their Use in Purifying or Concentrating Liquid Food Systems," *Activity Report, Research and Development Associates for Military Food and Packaging Systems* 44:164–181 (1992), no month provided.

Urano et al., "Separation Properties for Oligosaccharides of Nanofiltration Membranes and Its Application to a Purification Process of Jerusalem Artichoke Oligosaccharides," *Nippon Shokuhin Kagaku Kogaku Kaishi* 44:457–462 (1997), no month provided.

Madsen, "New Developments in the Purification of Beet Sugar," *Int. Sugar Jnl.* 92:221–223 (1990), no month provided.

Saska et al., "Direct Production of White Cane Sugar with Clarification and Decolorization Membranes—Part I," *Sugar Journal* 58:19–21 (1995), no month provided.

Saska et al., "Direct Production of White Cane Sugar with Clarification and Decolorization Membranes—Part II," *Sugar Journal* 58:29–31 (1995), no month provided.

Saska et al., "Concentration and Decolorization of Dilute Products from Cane Molasses Desugarization with Reverse Osmosis and Nanofiltration Membranes," 1994 Sugar Industry Technologists Meeting, Honolulu, Hawaii (May 8–11, 1994).

Cartier et al., "Développement Actuel et Potentiel Des Procédés À Membranes en Sucrerie et Raffinerie De Canne," *Ind. Alim. Agr. Juillet/Ao^^t*, pp. 557–560 (1996), no month provided.

Spengler et al., "Experiments on Raw Juice Extraction, Using a Continuously Operating Diffusor from Harburger Oelwerke Brinckman & Mergell," *Ztschr. Wirtschaftsgruppe Zuckerind* 91:275–333 (1941), no month provided.

Müller, "Extraction of Raw Juice According to the Steckel Process," *Zeitschrift fur die Zuckerindustrie*, pp. 207–209 (1961), no month provided.

"Desugarization of Sugar Beet Mash", no date provided.

Dörfeldt, "Raw Juice Extract from Beet Pulp," *Zuckerindustrie: Fachorgan für Technik, Rübenbau und Wirtschaft* 2:379–383 (1952), no month provided.

Schneider, "Beet Comminution," *Technologie des Zuckers*, pp. 135–136, 171 (excepts) (1968), no date provided.

SUGAR BEET MEMBRANE FILTRATION PROCESS

BACKGROUND OF THE INVENTION

The present invention relates to a process for obtaining sucrose from sugar beets.

The conventional beet sugar manufacturing process involves cleaning the beets, slicing them into cossettes, extracting juice from the cossettes by diffusion, purifying the juice by liming and carbonation, concentrating the juice by multiple effect evaporation, multi-stage boiling of concentrated juice in pans, separation, washing, and drying the sugar.

Purification of beet juice in the conventional process is based on lime treatment. Lime serves many purposes in the juice purification process. It neutralizes the acidity of the juice and precipitates calcium salts of several organic and inorganic acids. The precipitate absorbs other impurities. The lime precipitate produces a porous mass, which facilitates subsequent filtration of juice.

The conventional diffusion process for juice extraction from beets has some disadvantages. The conventional liming process uses large quantities of lime, amounting to about 2.5% of the total weight of beets processed. Beet sugar plants operate lime kilns and transport limestone over long distances for this purpose. The effluent from the liming-carbonation process, consisting of used lime and separated impurities, is disposed as waste. Production of lime and disposal of liming effluent are costly operations. Disposal of liming effluent is becoming increasingly difficult and expensive in many communities.

Conventional dead-end filtration is incapable of separating sucrose from macromolecular impurities in beet juice. Several methods of using microfiltration and ultrafiltration for purification of juice with reduced lime use have been reported, but these methods generally involve inserting microfiltration or ultrafiltration membranes into the conventional beet process at one or more points.

There is a long-standing need for improved processes for obtaining sugar from beets that avoid or at least minimize one or more of the problems existing in the previously used processes.

SUMMARY OF THE INVENTION

The present invention relates to a process for producing sugar from beets. A sucrose-containing feed juice that has been obtained by diffusion from sliced sugar beets is filtered through a first ultrafiltration membrane that has a first molecular weight cutoff. This ultrafiltration step produces a first ultrafiltration permeate and a first ultrafiltration retentate. The first ultrafiltration permeate is filtered through a second ultrafiltration membrane that has a second molecular weight cutoff that is lower than the first molecular weight cutoff. This second ultrafiltration step produces a second ultrafiltration permeate and a second ultrafiltration retentate. The second ultrafiltration permeate is nanofiltered through a nanofiltration membrane, thereby producing a nanofiltration permeate and a nanofiltration retentate. The nanofiltration retentate has a higher concentration of sucrose on a dry solids basis than the feed juice introduced into the first ultrafiltration step, and can be used in evaporation and crystallization operations to produce crystals of white sugar.

It is possible to introduce air into the feed juice prior to the first ultrafiltration, in order to oxidize color-forming materials. This oxidation, while increasing the color of the juice, causes the color-forming materials to polymerise, which facilitates their removal in the subsequent ultrafiltration. Another option is to introduce hydrogen peroxide, ozone, or both, into the feed juice prior to the first ultrafiltration. These materials also facilitate oxidation.

It is preferred to adjust the pH of the feed juice to about 6–8, for example by the addition of a base, prior to ultrafiltration. This can help minimize formation of invert.

The first ultrafiltration membrane preferably has a molecular weight cutoff of at least about 2,000 daltons and a pore size no greater than about 0.1 microns. More preferably, it has a molecular weight cutoff of about 4,000–200,000 daltons. The first ultrafiltration permeate preferably has a color of about 3,000–10,000 icu. (All color values given herein are determined on an ICUMSA scale.)

The process of the present invention can be operated at a number of different process conditions. As representative examples of such conditions, the feed juice can be at a temperature of about 140–200° F. during the first ultrafiltration, more preferably about 160–185° F.

The second ultrafiltration membrane preferably has a molecular weight cutoff of about 500–5,000 daltons, more preferably about 1,000–4,000 daltons. In one particular embodiment of the process, the second ultrafiltration is performed in two stages, the first stage using an ultrafiltration membrane having a molecular weight cutoff of about 3,500–4,000 daltons, and the second stage using an ultrafiltration membrane having a molecular weight cutoff of less than about 3,500 daltons. The second ultrafiltration permeate preferably has a color no greater than about 4,000 icu, more preferably no greater than about 2,500 icu.

In order to minimize loss of sucrose in the retentate from the first and second ultrafiltration steps, it is preferable to include diafiltration steps in the process. "Diafiltration" is used herein to mean ultrafiltration that employs added water in the feed to help flush sucrose through the membrane.

In one such embodiment of the process, the first ultrafiltration retentate is diafiltered through at least a first diafiltration/ultrafiltration membrane. This produces a first diafiltration permeate and a first diafiltration retentate. The first diafiltration permeate is then combined with the first ultrafiltration permeate and filtered through the second ultrafiltration membrane.

Similarly, the retentate from the second ultrafiltration can be diafiltered through at least a second diafiltration/ultrafiltration membrane. This second diafiltration step produces a second diafiltration permeate and a second diafiltration retentate. The second diafiltration permeate is then combined with the second ultrafiltration permeate and subsequently filtered through the nanofiltration membrane.

The retentates from the first and second ultrafiltrations (or diafiltrations) and the nanofiltration permeate can be combined to produce molasses. This combined stream may need to be concentrated by evaporation of water.

In addition to purification of the juice by nanofiltration, it is possible to include in the process ion exchange and/or electrodialysis purification steps. These three purification methods can be used in any sequence. In one particularly preferred embodiment of the process, the nanofiltration retentate is purified by electrodialysis, thereby producing a electrodialyzed juice and an electrodialysis residue, and then the electrodialyzed juice is purified by ion exchange, thereby producing a purified juice. Preferably, no lime and no carbon dioxide are contacted with any of the permeates.

The nanofiltration removes ash (including mono- and divalent cations), invert, organic acids, nitrogenous material and other low molecular weight organic or charged compounds. The nanofiltration and the optional electrodialysis and/or ion exchange preferably remove at least about 65% by weight of the Ca, Mg, K, Na and their associated inorganic and organic anions that are present in the second ultrafiltration permeate. The ion exchange replaces remaining divalent cations such as calcium and magnesium with monovalent cations such as potassium and sodium. Preferably, the nanofiltration retentate has a lower concentration of divalent cations on a dry solids basis than the second ultrafiltration permeate.

The nanofiltration permeate will contain a large percentage of the impurities that were present in the feed juice. For example, in many instances, the nanofiltration permeate will comprise at least about 30% by weight on a dry solids basis of the ash, at least about 30% of the invert, and at least about 25% of the betaine present in the feed juice.

The purified juice (i.e., after nanofiltration and any electrodialysis and/or ion exchange), preferably has an ash concentration of no greater than about 2.5% by weight on a dry solids basis, more preferably no greater than about 2%, most preferably no greater than about 1.0%.

After the membrane filtration steps (and any electrodialysis and/or ion exchange), water can be evaporated from the purified juice to produce a concentrated syrup (e.g., 75% dry solids). White sugar can then be crystallized from the concentrated syrup. Because of the high degree of removal of impurities, the present invention can achieve two crystallizations of white sugar from the concentrated syrup, as opposed to one in typical prior art beet processes.

A mother liquor will remain after one or more crystallizations of white sugar from the concentrated syrup. This mother liquor can be recycled to one of the ultrafiltrations. Optionally, this recycle stream can be further purified to reduce its raffinose content.

The process can optionally include sulfitation of one or more process streams. In particular, at least one aqueous stream selected from the group consisting of the feed juice, the first ultrafiltration permeate, the second ultrafiltration permeate, the nanofiltration retentate, and the evaporator feed can be contacted with an agent selected from the group consisting of sulfur dioxide, sulfite salts, bisulfite salts, metabisulfite salts, dithionites, and mixtures thereof, in an amount sufficient to provide an equivalent concentration of sulfur dioxide in the stream of at least about 100 ppm.

One particularly preferred embodiment of the invention is a process for producing sugar from beets that comprises the steps of:

(a) slicing sugar beets into cossettes and obtaining a sucrose-containing feed juice therefrom by diffusion;

(b) filtering the sucrose-containing feed juice through a first ultrafiltration membrane that has a molecular weight cutoff of about 4,000–200,000 daltons, thereby producing a first ultrafiltration permeate that has a color no greater than about 10,000 icu and a first ultrafiltration retentate;

(c) filtering the first ultrafiltration permeate through a second ultrafiltration membrane that has a molecular weight cutoff of about 2,000–4,000 daltons, thereby producing a second ultrafiltration permeate that has a color no greater than about 4,000 icu and a second ultrafiltration retentate; p1 (d) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the sucrose-containing liquid in step (b);

(e) purifying the nanofiltration rententate by at least one method selected from the group consisting of ion exchange and electrodialysis, thereby producing an evaporator feed;

(f) evaporating water from the evaporator feed to produce a concentrated syrup; and (g) crystallizing white sugar from the concentrated syrup.

Optionally, this embodiment of the process can further comprise the steps of:

(h) crystallising a mother liquor from the first crystallisation to produce white sugar;

(i) treating the mother liquor from the second crystallisation by chromatographic separation or by an enzyme to remove raffinose; and (j) recycling the treated mother liquor back to the nanofiltration feed or the evaporator feed.

Another aspect of the present invention is a process for purifying a sucrose-containing juice obtained from sugar beets. This process comprises the steps of: (a) introducing sufficient air into the juice to cause polymerisation of color bodies; and (b) removing at least some of the color bodies from the juice by membrane filtration through at least one ultrafiltration membrane or nanofiltration membrane.

The various aspects of the present invention have a number of advantages over prior art beet processes. For example, the process of the present invention eliminates the need for a lime kiln, lime quarries and all associated equipment, processes, products, by-products and waste products. Also, the present invention results in a drastic reduction of waste products that cause environmental pollution. The conventional process produces a filter cake that comprises products of the liming process and impurities removed from the juice. This cake is disposed into ponds or landfills. The proposed process completely eliminates the need for disposal of such materials. The present invention allows elimination of the carbonation process, which is a major source of atmospheric pollution in beet sugar plants.

The present invention provides a cost-effective way of reducing the ash content of the beet juice or syrup, preferably to about 2% or less (on a dry solids basis), more preferably to about 1.5% or less, most preferably to about 1% or less. This reduction in ash content is important because it allows a second strike of sucrose crystals from the syrup. In prior art beet processes, ash contents in the range of 3.5% made it practically impossible to have more than one strike of sucrose crystals.

In addition, the present invention can eliminate the need for desugarization of molasses streams. The efficient membrane filtration steps prevent excessive amounts of sucrose from entering the molasses streams in the first place.

Further, the present invention provides an economical and reliable method for removing color-causing materials from beet juice. It also can reduce the formation of undesirable crystalline forms due to the presence of excessive amounts of raffinose.

DETAILED DESCRIPTION OF SPECIFIC EMBODIMENTS

Figure 1:
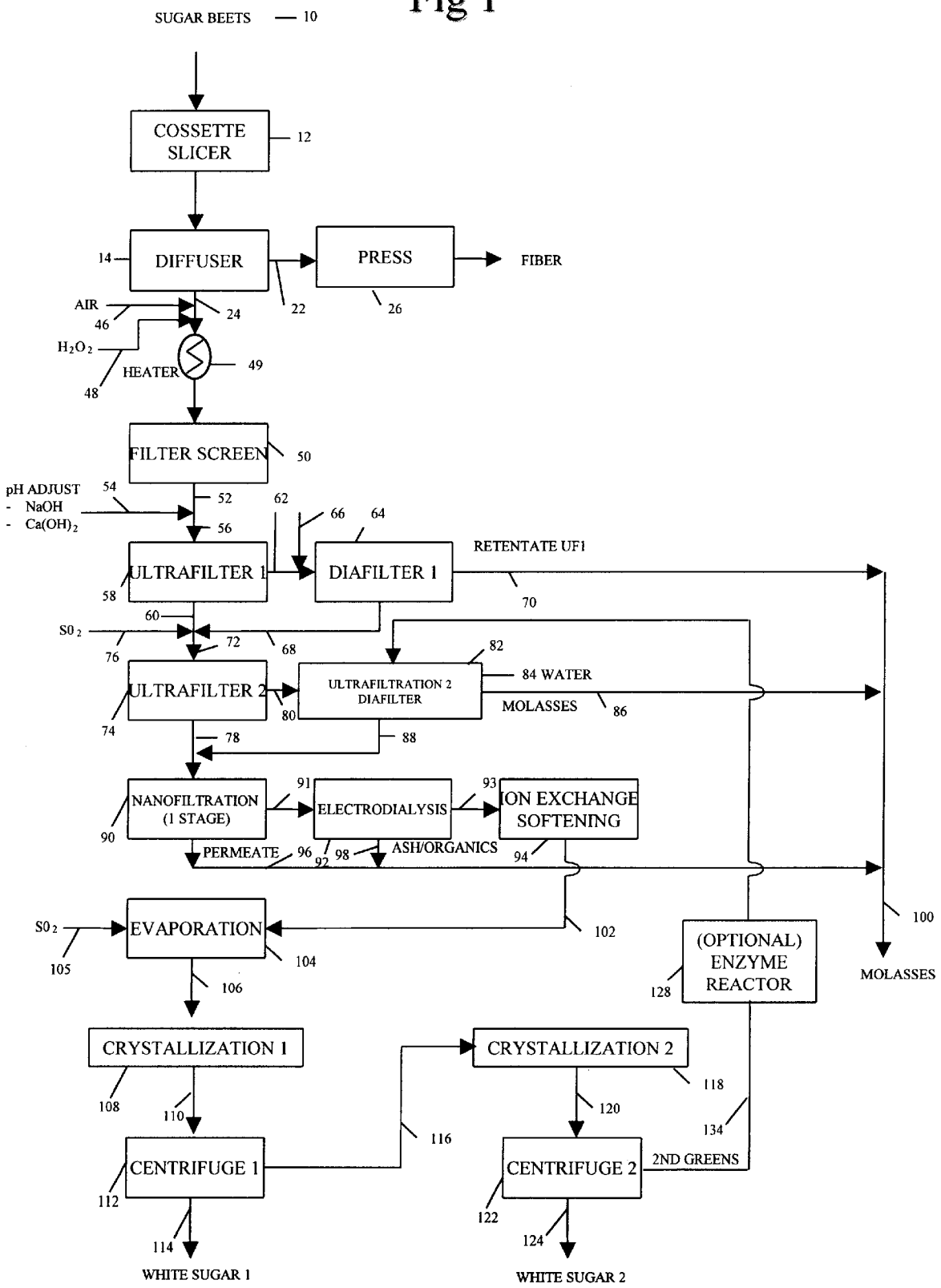
FIGS. 1 and 2 are process flow diagrams showing embodiments of the present invention in which sucrose is obtained from sugar beets.

The present invention provides an improved method for obtaining sucrose from sugar beets. Although the process of the present invention can be operated in batch mode, it is especially well suited for continuous operation. One embodiment of the invention is shown in FIG. 1. Beets received from the field are kept in a storage area 10. Fresh beets are typically used in the process, but frozen beets can also be used. Beets from the storage area are flumed in a conventional beet washing apparatus, in which dirt is removed from the exterior of the beets. The washed beets can be sliced into cossettes (e.g., having a thickness of about ¼ inch) in a slicing apparatus 12.

The sliced beets are carried by conveying apparatus to a diffuser 14. Juice extraction is done by allowing the sugar to diffuse through the natural cell walls of beets. The cell walls allow sugars and other low molecular weight compounds to pass through but prevent the passage of high molecular weight compounds. This selective diffusion process has two advantages. Retaining the high molecular weight compounds helps produce a high purity juice. It also reduces filtration difficulties that are caused by polysaccharides and proteins that comprise the high molecular weight compounds. The solid material 22 remaining after diffusion is fed to a press apparatus 26, in which additional juice is recovered that can be recycled to the diffuser 14. The solids remaining after pressing are high in fiber and can be used as animal feed.

The sucrose-containing juice 20 from the diffuser is then fed to the rest of the apparatus. The juice stream 20 can optionally have an air stream 46 injected into it. This will oxidize color-forming materials in the juice (e.g., resulting in a color increase from 8,000 to 16,000), which aids in the formation of polymerised color bodies and thereby facilitates removal of the color bodies in the subsequent ultrafiltration. It is also possible to inject a stream 48 of hydrogen peroxide solution, in addition to or instead of injecting air. The hydrogen peroxide also assists oxidation and polymerisation of color-forming materials. Alternatively, ozone could be injected in place of hydrogen peroxide. The temperature of the juice is preferably increased at this point in the process by a heater 49, preferably to about 140–200° F., more preferably about 160–185° F.

Optionally, the heated juice can be pre-filtered prior to the first ultrafiltration, in order to reduce its already low fiber content. The pre-filtration can be done, for example, with a rotating or vibrating screen 50. Preferably, the filter or screen 50 has a mesh size of about 30–100 microns, and removes the majority by weight of the fiber and silt remaining in the juice.

The heated and screened juice 52 can optionally have its pH adjusted by addition of a stream 54 that comprises, for example, aqueous sodium hydroxide, calcium hydroxide, or potassium carbonate. This pH adjustment helps prevent the inversion of sugars which can take place at elevated temperatures. Other chemicals may be also be used for pH adjustment, such as liquid potassium hydroxide or granular sodium or potassium carbonate. Preferably the pH of the juice after this step is between about 6.0–8.0, more preferably between about 6.5–7.5.

The juice after the pH adjustment, referred to herein as the ultrafiltration feed juice 56, is brought into contact with a first ultrafiltration membrane 58. This first ultrafiltration membrane is preferably tubular or spiral and preferably has a molecular weight cutoff of at least about 2,000 daltons and a pore size no greater than about 0.1 microns, more preferably having a molecular weight cutoff between about 4,000–500,000 daltons, most preferably between about 10,000–200,000.

The ultrafiltration step produces a first ultrafiltration permeate 60 and a first ultrafiltration retentate 62. In this embodiment of the process, the first ultrafiltration retentate 62 is then fed to a first ultrafiltration/diafiltration membrane 64 with addition of water 66. This ultrafiltration/diafiltration membrane can suitably have a pore size/molecular weight cutoff that is approximately the same as the first ultrafiltration membrane 58. This first diafiltration 64 produces a first diafiltration permeate 68 and a first diafiltration retentate 70 (also referred to as the molasses 1 stream). The diafiltration minimizes the amount of sucrose lost in the molasses (i.e., the concentration of sucrose on a dry solids basis (dsb) is lower in the retentate 70 than in the feed 62). It should be understood that there could be several stages of ultrafiltration 58 and/or diafiltration 64.

The first ultrafiltration permeate 60 typically will have a color of about 3,000–10,000 icu. The first ultrafiltration permeate 60 and the first diafiltration permeate 68 are combined to form the feed 72 for a second ultrafiltration membrane 74.

Prior to the second ultrafiltration, a sulfitation stream 76 can be injected into the juice 72. This stream 76 can comprise, for example, sulfur dioxide, or sulfite, bisulfite, metabisulfite, or dithionite salts, such as aqueous ammonium bisulfite or sodium bisulfite (e.g., at about 35–65% concentration). Preferably, the residual level of sulfur dioxide in the juice after sulfitation is at least about 100 ppm. The sulfitation can take place at one or more points in the process, for example, at the time of slicing or macerating the beets, in the juice after it is separated from the pulp, in the feeds to the first or second ultrafiltrations or to the nanofiltration, and/or in the feed to the evaporator. Most preferably, the sulfitation is done in the feed to the second ultrafiltration. This sulfitation will prevent the color increase that can otherwise take place during membrane filtration and evaporation operations. Other antioxidants may also be used, as well as anti-foaming agents.

The second ultrafiltration membrane 74 preferably has a molecular weight cutoff of about 500–5,000, more preferably about 2,000–4,000. The second ultrafiltration produces a second ultrafiltration permeate 78 and a second ultrafiltration retentate 80. The retentate 80 is then mixed with second greens 134, the mother liquor recycled from the second white sugar crystallisation, and passed through additional purification equipment 82. For example, this additional purification can be accomplished by chromatographic separation. Alternatively, or in addition to chromatographic separation, the retentate 80 and greens 134 can be filtered through a second ultrafiltration/diafiltration membrane with added water. The membrane used for the second diafiltration can suitably have a pore size/molecular weight cutoff that is lower in pore size than the second ultrafiltration membrane 74. This is to remove raffinose and a membrane with a pore size in the range 500–1,000 daltons is preferred. This step produces a second diafiltration permeate 88, which is mixed with the second ultrafiltration permeate 78 and fed to a nanofilter 90, and a second diafiltration retentate 86 (also referred to as the molasses 2 stream). There could be more than one stage of membrane filtration in the second ultrafiltration 74 and/or the second diafiltration. The permeate 78 from the second ultrafiltration preferably will have color in the range of 1,500–3,500, or in some cases even less.

Optionally, the second diafiltration permeate and/or the first diafiltration permeate 68 can be recycled into the diafiltration water streams.

Figure 2:
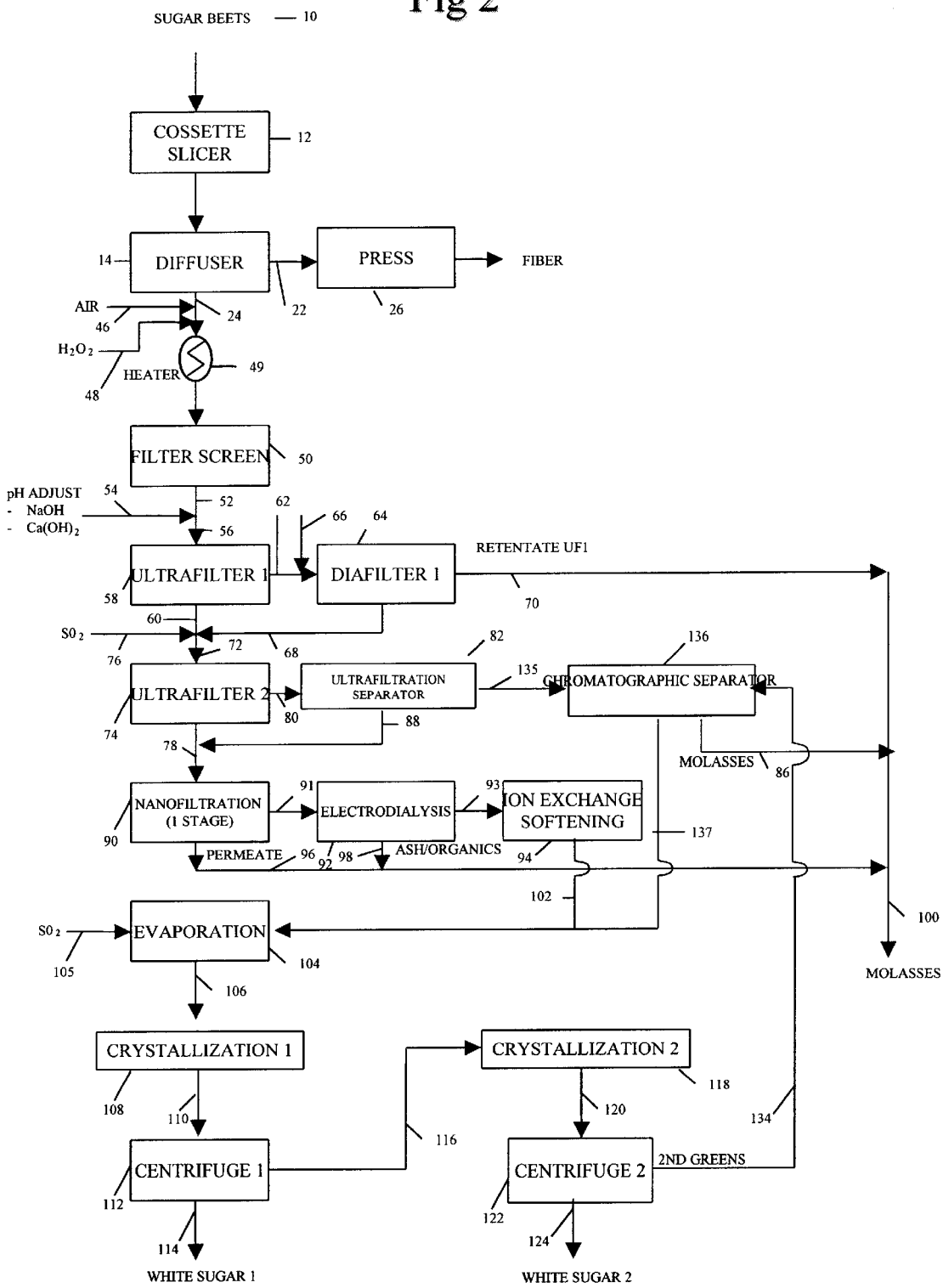

Alternatively, or in addition to ultrafiltration/diafiltration, the retentate 135 from the ultrafiltration/diafiltration can be mixed with greens 134 and purified by a chromatographic separation in a simulated moving bed separator system, as shown in FIG. 2. This chromatographic separator 136 preferably is a multistage unit with from three to twenty stages, more preferably ten stages. It preferably has three product cuts, one being predominantly sucrose, stream 137, another being predominantly raffinose and ash, stream 86, and the third being predominantly organic material including organic acids. The two non-sucrose streams can be mixed to give stream 86 (referred to as molasses 2). The resin used in the separator preferably is a strong acid cationic resin. The sucrose stream 137 is mixed with the feed to the evaporator 104. Alternatively, it could be added to the feed of the electrodialysis 92, or to the feed to the ion exchange 94, depending on the degree of removal of impurities.

The second ultrafiltration permeate 78 is then purified by nanofiltration, and optionally also ion exchange and/or electrodialysis, in any sequence. In the embodiment shown in FIG. 1, the ultrafiltered juice 78 is first nanofiltered 90, followed by electrodialysis 92 and ion exchange softening 94. Although the sequence of these three operations can be varied, it is usually preferable to perform electrodialysis after nanofiltration.

The feed to the nanofiltration membrane typically comprises about 84% sucrose, 3–6% ash, and about 0.5–4.0% invert sugar (all by weight on dsb). The nanofiltration membrane 90 separates the feed into a nanofiltration permeate 96 (also referred to as the molasses 3 stream) and a nanofiltration retentate 91 which will contain most of the sucrose from the beets. The nanofiltration permeate preferably contains at least about 30–60% by weight of the ash (primarily Na, K, and Cl), at least about 30–50% by weight of the invert (glucose and fructose), and at least about 25–50% by weight of the betaine present in the nanofiltration feed 78. The nanofiltration will accomplish some color reduction from the nanofiltration feed to the retentate. A typical nanofiltration permeate will comprise 20% sucrose, 25% ash, 20% invert, 8% betaine and 25% other organics (dsb). Preferably, the nanofiltration retentate 91 will contain at least about 89–91% by weight (dsb) sucrose and will have a concentration of about 15–28 Brix. Although nanofiltration can effectively remove potassium, it does not remove a large percentage of the citric, oxalic, and malic acid that is present.

The nanofiltration retentate 91 is then further purified by electrodialysis 92, which removes additional ash and various organic acids and other impurities, including some that cause undesirable color. Electrodialysis provides good removal of oxalic acid and malic acid, with the total ash removal typically being over 40%. The impurity stream 98 from the electrodialysis is combined with the streams 70, 86, and 96, to form a molasses product stream 100.

Although electrodialysis can achieve good removal of potassium, it does not typically remove a high percentage of the magnesium that is present. Therefore, the purified juice 93 from electrodialysis (which will typically contain about 92–94% sucrose dsb) preferably is then softened by ion exchange unit 94 which contains at least one ion exchange resin. A strong cation exchange resin based on a gel or macro-porous matrix, with cross-linking ranging from 4 to 10%, is preferred. Examples of these are resins such as Rohm & Haas Amberlite IR120, or Purolite C 100. These will be used in the sodium or potassium form. The primary purpose of this step is to remove divalent cations, such as Ca and Mg, and replace them with monovalent cations, such as K and Na. This ion exchange step preferably removes at least about 95% by weight of the Ca and Mg present.

The purified juice 102 from the ion exchange, which preferably comprises more than about 92% sucrose (dsb), is then fed to one or more evaporators 104, in which a concentrated syrup 106 is formed (e.g., about 75% dry solids) by removal of substantial quantities of water. Optionally, a sulfitation stream 105 can be injected into the evaporator. Preferably, the syrup will have a pH of about 6.5–7.5 and a temperature of about 160–180° F. during evaporation.

The concentrated syrup 106 is fed to a first crystallizer 108, in which water is boiled off and a first strike of white sugar crystals 110 is formed. The crystals 110 are centrifuged 112, washing with a water spray, to remove any residual liquid, and the remaining product is white sugar 114 (sucrose concentration of about 99.95%). The mother liquor 116 remaining after the first crystallization and centrifugation (typically containing about 84–88% sucrose dsb) is fed to a second crystallizer 118, in which a second strike of white sugar crystals 120 is formed. The crystals are also centrifuged 122 to produce white sugar 124. In prior art beet processes, the crystals produced in the second crystallizations were dissolved and recycled into the feed, because they were not pure enough to sell as white sugar. The present invention can achieve two strikes of highly pure white sugar, due to its improved purification capabilities. In a preferred embodiment, the crystallized sucrose (114 and 124) will comprise less than about 0.015% by weight ash, more preferably less than about 0.01% ash, and a color less than 35 iu.

The mother liquor 134 remaining after the second crystallization (also referred to as "greens" or "jets", and typically containing about 80% sucrose dsb) can be recycled, for example into the second ultrafiltration/diafiltration 82. Optionally, this greens recycle stream may be routed through a purification unit to remove raffinose. This purification can be done by chromatographic separation of raffinose (also resulting in dilution of the greens to about 60 Brix), or alternatively by enzymatic digestion of raffinose 128 (see FIG. 1). Preferably, if this enzymatic purification 128 is included in the process, the raffinose concentration in the greens is decreased to a level no greater than about 1.0% dsb. The enzyme used to hydrolyse raffinose is α-galactosidase (melibiase), splitting raffinose into sucrose and galactose. This can be carried out in a batch fashion in a stirred tank reactor at 50° C.

The process of the present invention can include multiple stages of ultrafiltration, nanofiltration, diafiltration, ion exchange, and/or electrodialysis. For example, the first ultrafiltration shown in FIG. 1 could take place in two or more stages of ultrafiltration, rather than taking place through a single membrane. Those skilled in the art will recognize that many other variations on the specific embodiment shown in the figure are also possible. It should also be recognized that the process can be operated at a variety of temperatures and other process conditions.

A variety of membrane configurations can be used in the present invention, including for example spiral, hollow fiber, and tubular membranes. These membranes can be made from a various materials including polymers, ceramics, carbon and sintered stainless steel. Membranes that have a negative surface charge are preferred since most compounds to be rejected are negatively charged.

Some of the equipment used in the process is conventional and well known to persons of ordinary skill in this field, such as beet washing equipment and evaporators. Beet diffusion apparatus is commercially available from suppliers such as BMA (Braunschweig, Germany) and Silver Engineering (Colorado Springs, Colo.). Suitable membrane filtration systems are available from suppliers such as Koch Membrane Systems, Inc. (Wilmington, Mass.), Osmonics, Inc. (Minnetonka, Minn.), PCI (UK), and SCT (France). Suitable ion exchange equipment and resins are available from Prosep (Roscoe, Ill.), IWT (Rockford, Ill.), Purolite (Philadelphia, Pa.), and Dow Chemical (Midland, Mich.). Suitable electrodialysis equipment is available from Eurodia (Paris, France) and Ameridia (Somerset, N.J.). Suitable chromatographic separation equipment is available from Prosep (Roscoe, Ill.) and Applexion (Paris, France). Suitable enzymes for digestion of raffinose are available from Novo (Denmark) or Hokkaido Sugar Co (Japan).

It would also be possible to include in the process a treatment with some amount of lime and/or carbonation. However, it is presently preferred to operate the process without the use of either lime or carbonation.

EXAMPLE 1a

Beet juice from a factory diffuser (colour about 4200 icu) was fed to the first centrifuge (with a 150 micron screen) to remove residual fibres, and heated to 70° C. It was aerated vigorously, screened (50 micron) and adjusted with sodium hydroxide to pH 8.0. The resulting juice was 17.5 RDS, apparent purity 85.1, colour 16400 and conductivity ash 5.3. It contained 0.09% fibre.

This juice was fed at 73° C. to the first ultrafiltration: an Osmonics PW, 4 inch diameter membrane module with spiral elements having a molecular weight cut off of 10–15, 000 Daltons, and a surface area of 4.3 $m^2$. The inlet pressure averaged 66 psi, the outlet 45 psi, and the cross flow rate was 193 liters/minute. The permeate flow rate was 1.9 liters/minute (corresponding to 26 liters/square meter/hour). The permeate was 15.5 RDS; apparent purity 85.6; colour 6697 icu, and ash 5.3%. The retentate was 12.5 RDS and 83.4 apparent purity. Diafiltration of the retentate using a PCI 20,000 Dalton molecular weight cut off tubular membrane produced a further 1.6 liters/min of permeate at 7 RDS. The permeates were mixed.

EXAMPLE 1b

The combined permeates from the first ultrafiltration system were fed at 65° C. to a second ultrafiltration system using two Osmonics GK and two Osmonics GE membrane 4 inch spiral modules. These membranes have 2000 Dalton and 1000 Dalton molecular weight cut offs respectively. It ran at input pressures averaging 250 psi and delivered a total of 2.2 liters/min of permeate (13.5 RDS, 85.0 apparent purity, 6.5% conductivity ash and 3297 colour). The retentate was 21.4 RDS and 83.8 apparent purity. The total membrane area was 24 square meters and the average flux rate was 5.5 liters/square meter/hour.

EXAMPLE 1c

The permeate from the second ultrafiltration membrane system was treated by nano filtration with 2 stages of 4 inch diameter Desal DS5 membranes The total membrane surface was 12 square metres, the inlet pressure 450 psi, and temperature 150 F. The feed flow was 0.75 gpm and the retentate flow 0.3 gpm. Diafiltration water was introduced into the second stage at 2.75 gph. The retentate (product) stream was 24.9 RDS; 90.6 apparent purity (90.8% b by HPLC); colour 2802 icu and 4.2% conductivity ash. The permeate was 5.2 RDS and 38.3 apparent purity.

EXAMPLE 1d

The nano filtration retentate from example 1c was treated by electrodialysis in a stack comprising 40 cationic/anionic membrane pairs, each pair had 0.1 $m^2$ of membrane surface. The stack operated at 45–55° C.; with 18–30 volts and a current of 2–3 amps. The anolyte and catholyte systems contained dilute sulphamic acid (20 mS/cm conductivity) which circulated through the stack at 3 gpm. The stream being treated circulated at 8 gpm, and the equipment was operated in a batch mode. The stack was operated at 40–50° C.; with 12–23 volts and a current of 3 amps. The feed and product ionic compositions were:

| | % of Ions on Solids | | | | | | | | % |
|---|---|---|---|---|---|---|---|---|---|
| | Ca | Mg | K | Na | Cl | PO4 | SO4 | Oxalate | Ash |
| Feed | 0.001 | 0.12 | 0.65 | 0.61 | 0.049 | 0.146 | 0.523 | 0.628 | 3.9 |
| Product | 0.003 | 0.02 | 0.19 | 0.19 | 0.021 | 0.046 | 0.061 | 0.073 | 1.2 |

The product was at 92.5% purity (by HPLC)

EXAMPLE 1e

The product from electrodialysis (after adding about 900 ppm of $SO_2$ as an ammonium bisulphite solution) was evaporated to give a syrup at 69 Brix (colour 3060 icu). The evaporator was a single effect APV plate and frame unit, and was operated at 8 psia and the syrup temperature was about 85° C. The feed into the evaporator was 1 liter/minute at 24 Bx.

The evaporated syrup was crystallised under vacuum to give a white sugar with 17.3 icu colour and a conductivity ash of 0.007%. The crystallisation was carried out in batch mode in a crystalliser containing 50 liters of massecuite. The crystalliser was a pilot unit made by Pignat of Genas, France. Crystallisation pressure and temperature were 20 in Hg abs and 70–75° C. and crystallisation took 2 hours. The massecuite formed by crystallisation was centrifuged on a 2 foot basket centrifuge using a perforated basket.

The mother syrup (separated by centrifugation) had an apparent purity of 80.3% and a colour of 5380 icu.

EXAMPLE 1f

The mother syrup produced by the methods of Example 1e was further crystallised in the Pignat crystalliser at 20 in Hg abs and 70–75° C. over 3 hours. The massecuite was centrifuged on a 2 foot basket centrifuge and gave a second sugar of color 40 iu and 0.019 ash.

EXAMPLE 2a 55 gallons of fresh beet diffuser juice at 16.5 Brix and 3850 icu colour, was adjusted to pH 8 with sodium hydroxide solution. 2.2 liters of 3% (v/v) hydrogen peroxide were added (0.03% on juice or 0.19% on solids). The juice heated to 80 ° C for 60 min during which time the colour rose to 14,000 icu. Ultrafiltration through a 4000 Dalton molecular weight cut off PCI tubular membrane running at 300 psi yielded a permeate at 2100 colour and a retentate at 50,000 icu.

The permeate was evaporated and crystallised under vacuum, in equipment and under conditions similar to those in Example 1e. Colour was generated during this evaporation to give a crystallisation massecuite at 4450 icu. Centrifugation and washing gave crystals at 46 icu. In a further experiment, 200 ppm $SO_2$ was added to the crystallisation giving 34 icu color crystals, from a massecuite of 3950 colour.

EXAMPLE 2b

The work in Example 2a was repeated, but feeding the oxidation with beet diffuser juice that had been heated and aerated as described in Example 1a. The feed colour was 12,123 icu. Peroxide treatment raised this to 14,473 icu and ultrafiltration gave a permeate at 2707 icu.

EXAMPLE 3

The juice comprising a mixture of the mother liquor from white sugar crystallisations and the retentate from a second ultrafiltration can be evaporated to 60 RDS and passed at a rate of 1.0 liters/hour over a simulated moving bed separating system, containing 5.8 liters of resin distributed among 10 cells. Water can be injected at 4 liters per hour and the system operated at a temperature of 70° C. Three fractions were collected from the system containing respectively, most of the organics; most of the sucrose; and most of the raffinose plus other organic materials. Typical properties of each of these fractions are given in the tables below. ("Organics" represent materials calculated by difference from the analytical results.)

| | Flow 1/hour | RDS | Sucrose | Invert | Ash | Raffinose | Organics | Colour iu |
|---|---|---|---|---|---|---|---|---|
| Feed | 1.0 | 60 | 67.5 | 5.0 | 6.2 | 7.4 | 17.3 | 37,000 |
| Organic fraction | 0.7 | 1.0 | 12 | 11.1 | 18.2 | 0.0 | 58 | 31,200 |
| Sucrose fraction | 1.9 | 27.9 | 96.5 | 1.0 | 0.4 | 2.5 | 0.0 | 6900 |
| Raffinose fraction | 2.6 | 9.1 | 15.1 | 8.7 | 19.2 | 22.3 | 42.5 | 85,700 |

The sucrose fraction obtained typically is 96.5% pure and represents a recovery of 90.5% of the sucrose input.

EXAMPLE 4

500 grammes of the mother liquor from the first crystallisation of white sugar (at about 75 RDS, and containing 2.6% raffinose on solids) was diluted to 30 RDS with water. The pH was adjusted to 5.0 by adding dilute sulphuric acid and the solution temperature brought to 50° C. $2.5\times10^7$ units of pelleted alpha galactosidase enzyme were added (12.2 grammes) and the solution stirred at 50° C. for 2 hours. The resulting juice was analysed and found to contain 0.9% raffinose on solids.

EXAMPLE 5

The mother syrup from the crystallisation of a first strike of white sugar (colour 4094 icu at 80.8% apparent purity) was crystallised under vacuum to give a second crop of white sugar with colour 28 icu and a conductivity ash of 0.024%. The crystallisation was carried out in batch in a crystalliser containing 50 liters of massecuite. The crystalliser was a pilot unit manufactured by Pignat of Genas, France. Crystallisation pressure and temperature were 20 inch 22 Hg abs and 70–75° C., and crystallisation took about 2 hours. The massecuite formed by crystallisation was centrifuged on a 2 foot basket centrifuge using a perforated basket. The mother syrup (separated by centrifugation) had an apparent purity of 77.4% and a colour of 5807 icu.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for producing sugar from beets, comprising the steps of:

(a) slicing sugar beets into cossettes and obtaining a sucrose-containing feed juice therefrom by diffusion, wherein the feed juice also comprises ash and invert sugars;

(b) filtering the sucrose-containing feed juice through a first ultrafiltration membrane that has a first molecular weight cutoff of at least about 2,000 daltons and a pore size no greater than about 0.1 microns, thereby producing a first ultrafiltration permeate and a first ultrafiltration retentate;

(c) filtering the first ultrafiltration permeate through a second ultrafiltration membrane that has a second molecular weight cutoff that is lower than the first molecular weight cutoff and is between about 500–5,000 daltons; thereby producing a second ultrafiltration permeate and a second ultrafiltration retentate; and (d) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the feed juice in step (c), and wherein the nanofiltration permeate comprises at least about 30% by weight of the ash and at least about 30% by weight of the invert sugars present in the second ultrafiltration permeate.

2. The process of claim 1, further comprising the step of purifying either the second ultrafiltration permeate or the nanofiltration retentate by at least one method selected from the group consisting of ion exchange and electrodialysis.

3. The process of claim 2, wherein the nanofiltration retentate is purified by electrodialysis, thereby producing a electrodialyzed juice and an electrodialysis residue.

4. The process of claim 3, wherein the electrodialyzed juice is softened by ion exchange, thereby producing a softened purified juice.

5. The process of claim 4, wherein the nanofiltration, electrodialysis, and ion exchange remove at least about 65% by weight of the Ca, Mg, K, Na and their associated inorganic and organic anions that are present in the second ultrafiltration permeate.

6. The process of claim 4, further comprising evaporating the purified juice to produce a concentrated syrup, and crystallizing white sugar from the concentrated syrup.

7. The process of claim 6, wherein the purified juice has an ash concentration of no greater than about 2.5% by weight on a dry solids basis.

8. The process of claim 7, wherein the purified juice has an ash concentration of no greater than about 2.0% by weight on a dry solids basis.

9. The process of claim 8, wherein the purified juice has an ash concentration of no greater than about 1.0% by weight on a dry solids basis.

10. The process of claim 6, wherein the process comprises two crystallizations of white sugar from the concentrated syrup.

11. The process of claim 6, wherein a mother liquor remains after crystallization of white sugar from the concentrated syrup, and the mother liquor is recycled to one of the ultrafiltration membranes.

12. The process of claim 4, wherein at least one aqueous stream selected from the group consisting of the feed juice, the first ultrafiltration permeate, the second ultrafiltration permeate, the nanofiltration retentate, and the purified juice is contacted with an agent selected from the group consisting of sulfur dioxide, sulfite salts, bisulfite salts, and mixtures thereof, in an amount sufficient to provide an equivalent concentration of sulfur dioxide in the stream of at least about 100 ppm.

13. The process of claim 3, wherein at least two of the first ultrafiltration retentate, the second ultrafiltration retentate, the nanofiltration permeate and the electrodialysis residue are combined to produce molasses.

14. The process of claim 1, wherein air is introduced into the feed juice prior to the first ultrafiltration to polymerise color bodies.

15. The process of claim 1, wherein hydrogen peroxide, ozone, or a combination thereof is introduced into the feed juice prior to the first ultrafiltration.

16. The process of claim 1, wherein the pH of the juice is adjusted to about 6–8 by addition of a base, prior to the first ultrafiltration.

17. The process of claim 1, further comprising the step of removing residual beet fibers and silt from the separated liquid, by at least one method selected from the group consisting of screening and filtration, prior to the first ultrafiltration.

18. The process of claim 17, wherein the screening or filtration removes at least 90% by weight of all fibers and silt having a largest dimension of about 150 $\mu$m or greater.

19. The process of claim 18, wherein the screening or filtration removes at least 90% by weight of all fibers and silt having a largest dimension of about 50 $\mu$m or greater.

20. The process of claim 1, wherein the first ultrafiltration retentate is diafiltered through at least a first diafiltration/ultrafiltration membrane, thereby producing a first diafiltration permeate and a first diafiltration retentate; and wherein the first diafiltration permeate is filtered through the second ultrafiltration membrane.

21. The process of claim 20, wherein the second ultrafiltration retentate is diafiltered through at least a second diafiltration/ultrafiltration membrane, thereby producing a second diafiltration permeate and a second diafiltration retentate; and wherein the second diafiltration permeate is filtered through the nanofiltration membrane.

22. The process of claim 21, wherein at least the first diafiltration retentate, the second diafiltration retentate, and the nanofiltration permeate are combined to produce molasses.

23. The process of claim 1, further comprising evaporating the nanofiltration retentate to produce a concentrated syrup, and crystallizing white sugar from the concentrated syrup.

24. The process of claim 23, wherein a mother liquor remains after crystallization of white sugar from the concentrated syrup, and the mother liquor is recycled to one of the ultrafiltration membranes.

25. The process of claim 1, wherein the feed juice is at a temperature of about 140–200° F. during filtration through the first ultrafiltration membrane.

26. The process of claim 25, wherein the feed juice is at a temperature of about 160–185° F. during filtration through the first ultrafiltration membrane.

27. The process of claim 1, wherein the first ultrafiltration membrane has a molecular weight cutoff of about 4,000–200,000 daltons.

28. The process of claim 1, wherein the first ultrafiltration permeate has a color of about 3,000–10,000 icu.

29. The process of claim 1, wherein the second ultrafiltration membrane has a molecular weight cutoff of about 1,000–4,000 daltons.

30. The process of claim 1, wherein the second ultrafiltration permeate has a color no greater than about 4,000 icu.

31. The process of claim 1, wherein the second ultrafiltration permeate has a color no greater than about 2,500 icu.

32. The process of claim 1, wherein the nanofiltration permeate comprises at least about 30% by weight on a dry solids basis of the ash present in the feed juice.

33. The process of claim 1, wherein the nanofiltration permeate comprises at least about 30% by weight on a dry solids basis of the invert sugars present in the feed juice.

34. The process of claim 1, wherein the nanofiltration permeate comprises at least about 25% by weight on a dry solids basis of the betaine present in the feed juice.

35. The process of claim 1, wherein at least one aqueous stream selected from the group consisting of the feed juice, the first ultrafiltration permeate, the second ultrafiltration permeate, and the nanofiltration retentate is contacted with an agent selected from the group consisting of sulfur dioxide, sulfite salts, bisulfite salts, metabisulfite salts, dithionite salts, and mixtures thereof, in an amount sufficient to provide an equivalent concentration of sulfur dioxide in the stream of at least about 100 ppm.

36. The process of claim 1, where no lime and no carbon dioxide are contacted with any of the permeates.

37. The process of claim 1, further comprising the step of introducing sufficient air into the feed juice to cause polymerization of color bodies prior to filtration through the first ultrafiltration membrane; wherein at least some of the color bodies are removed from the juice by the first ultrafiltration membrane filtration.

38. The process of claim 37, further comprising heating the juice to a temperature of about 140–200° F. prior to filtration through the first ultrafiltration membrane.

39. A process for producing sugar from beets, comprising the steps of:

(a) slicing sugar beets into cossettes and obtaining a sucrose-containing feed juice therefrom by diffusion, wherein the feed juice also comprises ash and invert sugars;

(b) filtering the sucrose-containing feed juice through a first ultrafiltration membrane that has a molecular weight cutoff of about 4,000–200,000 daltons, thereby producing a first ultrafiltration permeate that has a color no greater than about 10,000 icu and a first ultrafiltration retentate;

(c) filtering the first ultrafiltration permeate through a second ultrafiltration membrane tat has a molecular weight cutoff of about 2,000–4,000 daltons, thereby producing a second ultrafiltration permeate that has a color no greater than about 4,000 icu and a second ultrafiltration retentate;

(d) filtering the second ultrafiltration permeate through a nanofiltration membrane; thereby producing a nanofiltration permeate and a nanofiltration retentate, wherein the nanofiltration retentate has a higher concentration of sucrose on a dry solids basis than the sucrose-containing liquid in step (b), and wherein the nanofiltration permeate comprises at least about 30% by weight of the ash and at least about 30% by weight of the invert sugars present in the second ultrafiltration permeate;

(e) purifying the nanofiltration retentate by at least one method selected from the group consisting of ion exchange and electrodialysis, thereby producing an evaporator feed;

(f) evaporating water from the evaporator feed to produce a concentrated syrup; and (g) crystallizing white sugar from the concentrated syrup.

40. The process of claim 39, wherein the process comprises at least two crystallizations of white sugar from the concentrated syrup.

41. The process of claim 39, wherein a mother liquor produced in the crystallization comprises raffinose, and at least 75% by weight of the raffinose is removed from the mother liquor in a simulated moving bed chromatographic separator, and the treated liquor is recycled.

42. The process of claim 41, wherein the recycled liquor is subjected to further purification, evaporation and crystallisation.

43. The process of claim 39, wherein a mother liquor produced in the crystallization comprises raffinose, and at least 75% by weight of the raffinose is removed from the mother liquor using melibiase enzyme, and the treated liquor is recycled to the feed of the second ultrafiltration membrane.

* * * * *

UNITED STATES PATENT AND TRADEMARK OFFICE

CERTIFICATE OF CORRECTION

PATENT NO. : 6,406,547 B1 
DATED : June 18, 2002
INVENTOR(S) : Michael Donovan et al.

It is certified that error appears in the above-identified patent and that said Letters Patent is hereby corrected as shown below:

Column 14,
Line 63, delete “tat” and insert -- that --.

Signed and Sealed this

Thirtieth Day of July, 2002

*Attest:*

*Attesting Officer*

JAMES E. ROGAN
*Director of the United States Patent and Trademark Office*